US010662563B2

(12) United States Patent
Kamihira et al.

(10) Patent No.: US 10,662,563 B2
(45) Date of Patent: May 26, 2020

(54) NON-TRANSITORY COMPUTER-READABLE STORAGE MEDIUM AND SEWING MACHINE

(71) Applicant: BROTHER KOGYO KABUSHIKI KAISHA, Nagoya-shi, Aichi-ken (JP)

(72) Inventors: Yuta Kamihira, Nagoya (JP); Yukiyoshi Muto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 170 days.

(21) Appl. No.: 16/012,381

(22) Filed: Jun. 19, 2018

(65) Prior Publication Data

US 2019/0003093 A1 Jan. 3, 2019

(30) Foreign Application Priority Data

Jun. 30, 2017 (JP) ..... 2017-129053

(51) Int. Cl.
*D05B 19/10* (2006.01)
*D05B 19/08* (2006.01)
(Continued)

(52) U.S. Cl.
CPC ..... *D05B 19/10* (2013.01); *D05B 11/00* (2013.01); *D05B 19/08* (2013.01); *D05B 19/12* (2013.01);
(Continued)

(58) Field of Classification Search
CPC ..... D05B 19/00; D05B 19/10; D05B 19/08; D05B 19/12; D05B 19/16; D05B 19/02;
(Continued)

(56) References Cited

U.S. PATENT DOCUMENTS 6,237,516 B1 * 5/2001 Wakayama ..... D05B 19/105 112/102.5
2008/0127870 A1 6/2008 Tashiro
(Continued)

FOREIGN PATENT DOCUMENTS

JP 2008-136623 A 6/2008
JP 2008-136624 A 6/2008
(Continued)

*Primary Examiner* — Ismael Izaguirre
(74) *Attorney, Agent, or Firm* — Oliff PLC

(57) ABSTRACT

A non-transitory computer-readable medium storing computer-readable instructions. The instructions, when executed, cause a processor of a sewing data generation device configured to generate sewing data to perform steps. The steps include acquiring a sewing area in which a pattern is to be sewn and acquiring a target area in which a pattern is to be arranged. The steps further include generating a plurality of sewing data. Each of the plurality of sewing data is data to form stitches of a plurality of stippling patterns inside the acquired target area. The steps further include associating the sewing data with arrangement information, for each of the plurality of sewing data, and outputting the sewing data and arrangement information that have been associated with each other. The arrangement information indicates an arrangement of each of the stippling patterns to be sewn on the basis of the sewing data.

10 Claims, 8 Drawing Sheets

(51) Int. Cl.

| | |
|---|---|
| ***D05B 19/12*** | (2006.01) |
| ***D05B 19/16*** | (2006.01) |
| ***D05C 5/06*** | (2006.01) |
| ***D05B 11/00*** | (2006.01) |

(52) U.S. Cl.
CPC ..... *D05B 19/16* (2013.01); *D05C 5/06* (2013.01); *D05D 2305/36* (2013.01)

(58) Field of Classification Search
CPC ..... D05B 19/04; D05B 11/00; D05C 5/02; D05C 5/04; D05C 5/06; D05D 2305/36
See application file for complete search history.

(56) References Cited

U.S. PATENT DOCUMENTS

| | | | | |
|---|---|---|---|---|
| 2008/0127871 | A1 | 6/2008 | Tashiro | |
| 2010/0050914 | A1 | 3/2010 | Kongo et al. | |
| 2011/0146553 | A1* | 6/2011 | Wilhelmsson ..... | D05B 19/10 112/475.19 |
| 2011/0226171 | A1* | 9/2011 | Tokura ..... | D05B 19/10 112/470.05 |
| 2012/0272884 | A1 | 11/2012 | Tokura | |
| 2013/0081562 | A1* | 4/2013 | Tokura ..... | D05B 19/12 112/78 |
| 2013/0112127 | A1* | 5/2013 | Tokura ..... | D05C 5/06 112/102.5 |
| 2016/0010252 | A1* | 1/2016 | Yamanashi ..... | D05B 19/10 700/138 |

FOREIGN PATENT DOCUMENTS

| | | | |
|---|---|---|---|
| JP | 2010-51505 | A | 3/2010 |
| JP | 2012-228472 | A | 11/2012 |

* cited by examiner

NON-TRANSITORY COMPUTER-READABLE STORAGE MEDIUM AND SEWING MACHINE

CROSS-REFERENCE TO RELATED APPLICATION

This application claims priority to Japanese Patent Application No. 2017-129053 filed on Jun. 30, 2017, the disclosure of which is herein incorporated by reference in its entirety.

BACKGROUND

The present disclosure relates to a non-transitory computer-readable storage medium and a sewing machine.

In related art, a sewing data creation device is known that creates sewing data to sew a stippling pattern using an embroidery sewing machine. The stippling pattern is one type of pattern in quilting sewing. The quilting sewing is a sewing technique in which a batting is inserted between an outer fabric and a backing fabric and they are stitched together using a stitch pattern formed by straight lines, curved lines and the like. The above-described sewing data creation device sets a stitch path on a contour line net. The contour line net is created from contour lines of unit patterns each having a predetermined shape.

SUMMARY

In the known sewing data creation device, a case in which the stippling pattern is sewn over an area larger than a size of a sewing area set inside an embroidery frame is not taken into consideration. There is a case in which the sewing data creation device divides the stitch path in accordance with the size of the sewing area after setting the stitch path of the stippling pattern in an area larger than the size of the sewing area. In this case, it may become difficult to perform sewing by aligning positions of end portions of the divided stitches.

Various embodiments of the broad principles derived herein provide a non-transitory computer-readable storage medium and a sewing machine that are configured to generate sewing data which are used to sew a stippling pattern over an area larger than a size of a sewing area, and which achieve a more natural embroidery finish than in related art.

Embodiments herein provide a non-transitory computer-readable medium storing computer-readable instructions. The instructions, when executed, cause a processor of a sewing data generation device configured to generate sewing data to perform steps. The steps include acquiring a sewing area in which a pattern is to be sewn. The steps further include acquiring a target area in which a pattern is to be arranged. The steps further include generating a plurality of sewing data. Each of the plurality of sewing data is data to form stitches of a plurality of stippling patterns inside the acquired target area. Each of the plurality of sewing data is data to form stitches of the stippling pattern on a stitch path having a size that is contained within the acquired sewing area. A first path and a second path are separated from each other. Each of the first path and the second path is one of a plurality of the stitch paths represented by the plurality of sewing data. The second path is adjacent to the first path. Each of the first path and the second path has a convex portion. Positions of the convex portions in an adjacent direction are the same as each other. The adjacent direction is a direction in which the first path and the second path are adjacent to each other inside the target area. The steps further include associating the sewing data with arrangement information, for each of the plurality of sewing data, and outputting the sewing data and arrangement information that have been associated with each other. The arrangement information indicates an arrangement of each of the stippling patterns to be sewn on the basis of the sewing data, with respect to the target area.

Embodiments herein provide a sewing machine including a sewing portion, a movement portion, a processor; and a memory. The sewing portion is configured to move a needle bar up and down. The movement portion is configured to move an embroidery frame with respect to the needle bar. The embroidery frame is configured to hold a sewing object. The memory stores computer-readable instructions that, when executed by the processor, cause the sewing machine to perform steps. The steps include acquiring a sewing area which is to be set inside the embroidery frame and in which sewing is to be performed. The steps further include acquiring a target area in which a pattern is to be arranged. The steps further include generating a plurality of sewing data. Each of the plurality of sewing data is data to form stitches of a plurality of stippling patterns inside the acquired target area. Each of the plurality of sewing data is data to form stitches of the stippling pattern on a stitch path having a size that is contained within the acquired sewing area. Each of the plurality of sewing data is data satisfying a condition that a first path and a second path be separated from each other. The first path and the second path are separated from each other. Each of the first path and the second path is one of a plurality of the stitch paths represented by the plurality of sewing data. The second path is adjacent to the first path. Each of the first path and the second path each has a convex portion. Positions of the convex portions in an adjacent direction are the same as each other. The adjacent direction is a direction in which the first path and the second path are adjacent to each other inside the target area. The steps further include associating the sewing data with arrangement information, for each of the plurality of sewing data, and outputting the sewing data and arrangement information that have been associated with each other. The arrangement information indicates an arrangement of each of the stippling patterns to be sewn on the basis of the sewing data, with respect to the target area. The steps further include sewing the stippling patterns in the target area by controlling the sewing portion and the movement portion on the basis of the sewing data and the arrangement information.

BRIEF DESCRIPTION I/F THE DRAWINGS

Embodiments will be described below in detail with reference to the accompanying drawings in which:

FIG. 1 is a schematic diagram of a sewing system 30 provided with a sewing machine 10 and a sewing data generation device 20;

Figure 5:
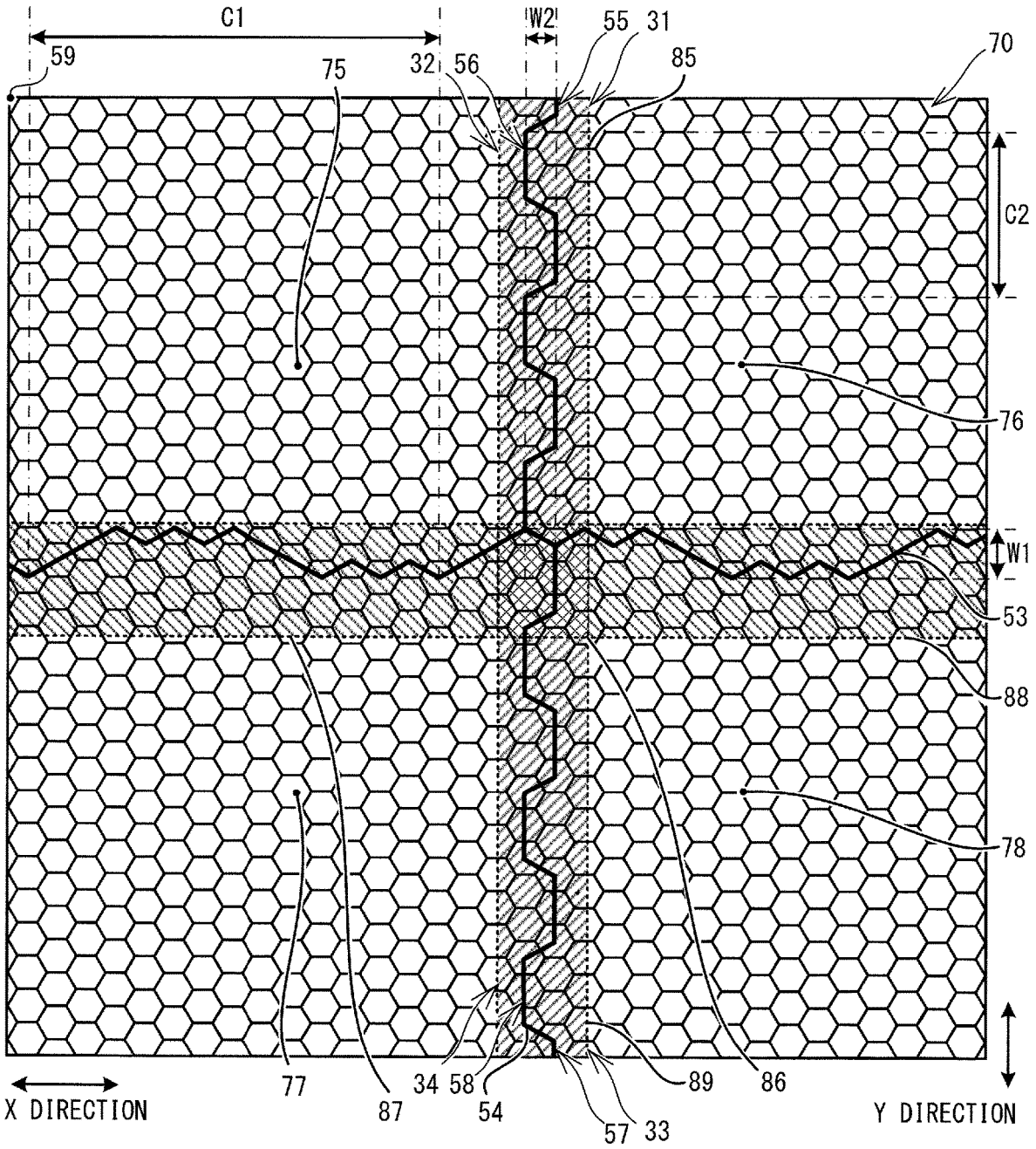
Figure 6:
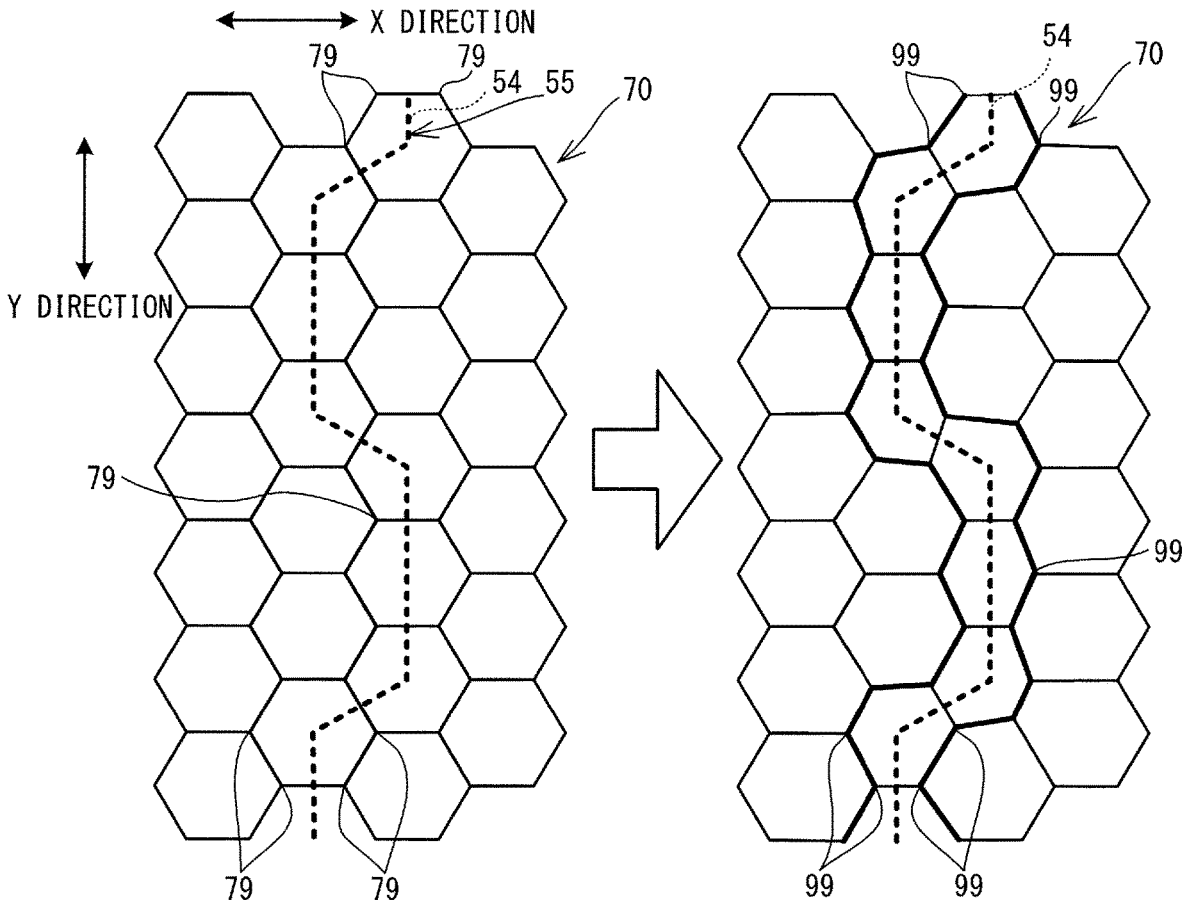
Figure 7:
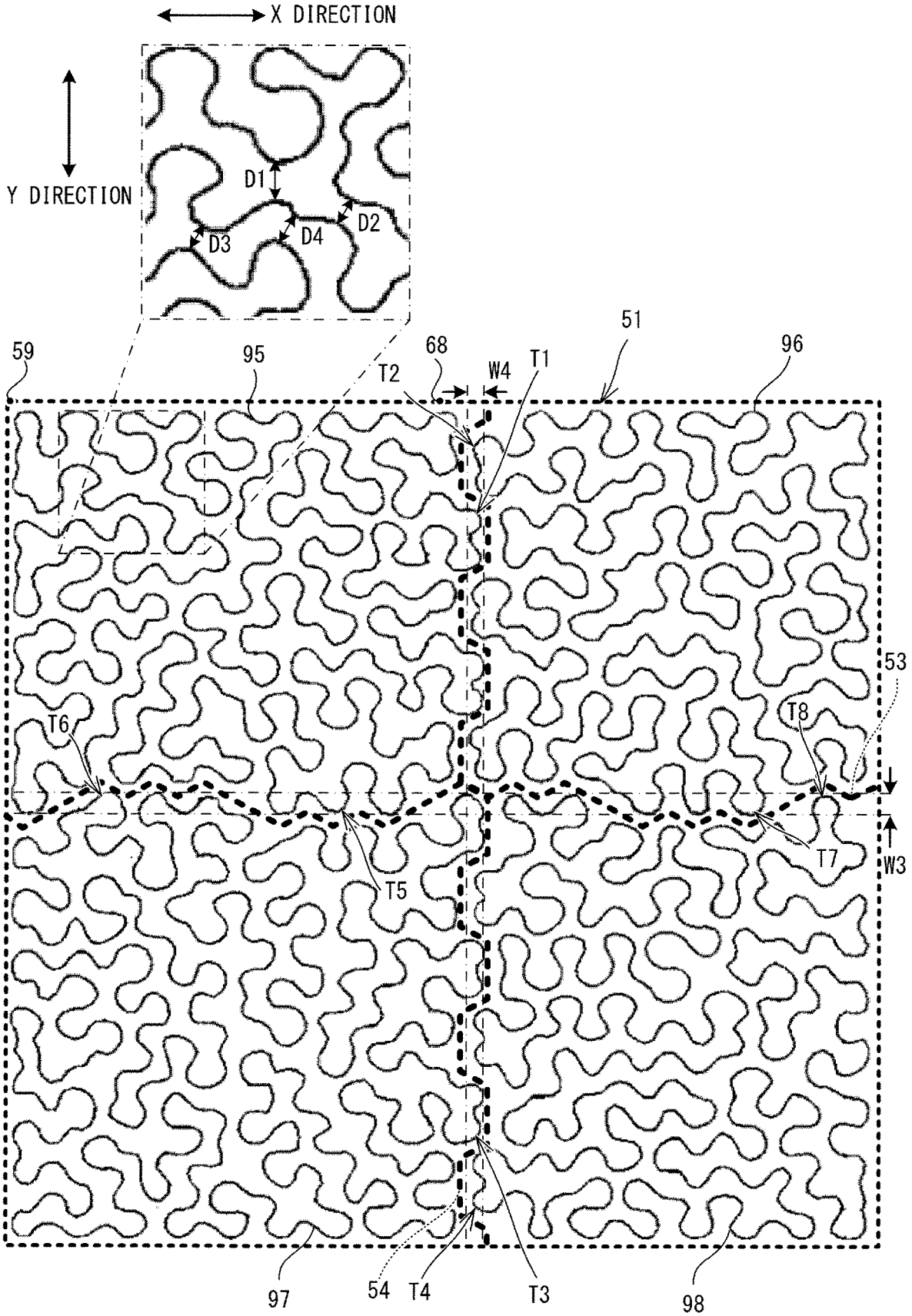
Figure 8:
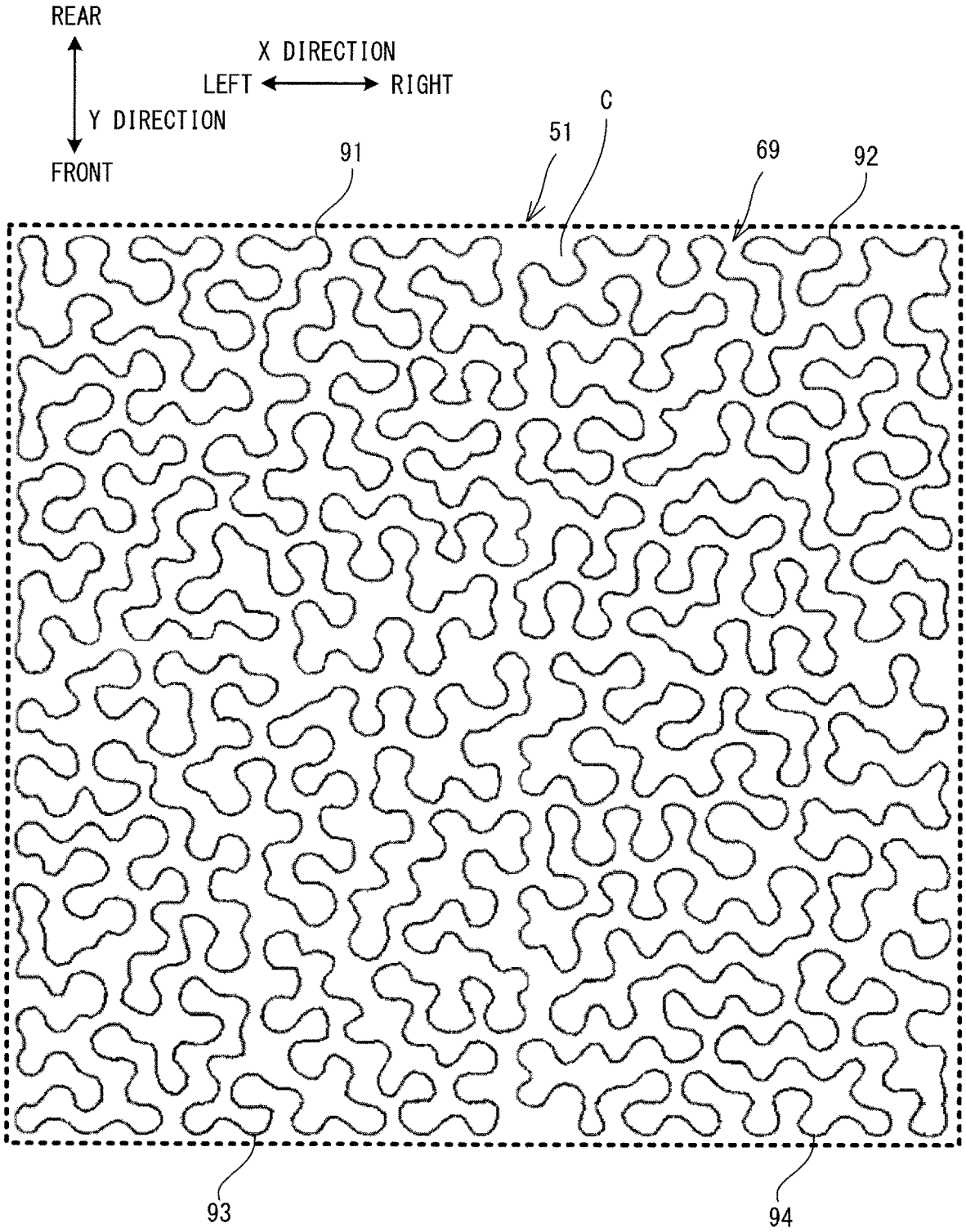

FIG. 5 is an explanatory diagram of processing that sets boundary lines 53 and 54 in overlapping areas 85 to 89;

FIG. 6 is an explanatory diagram of processing that moves vertices of a contour line net 70 to the boundary line 54 side;

FIG. 7 is an explanatory diagram of stitch paths 95 to 98 that are set in a plurality of pattern arrangement areas; and FIG. 8 is a diagram showing a finished image when a stippling pattern 69 is sewn in the target area 51 of a sewing object C in accordance with sewing data.

DETAILED DESCRIPTION

Figure 1:
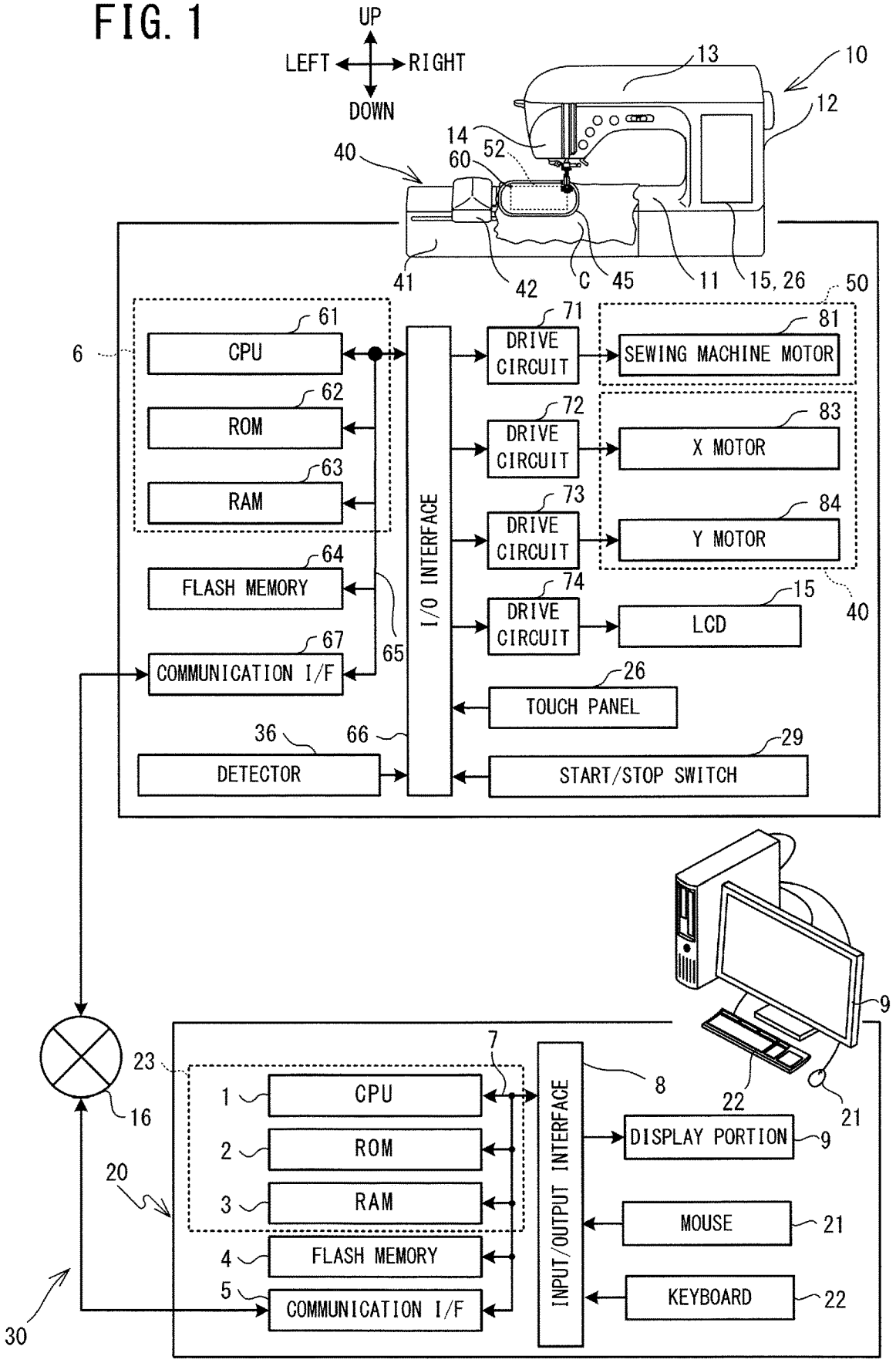

An embodiment of the present disclosure will be explained with reference to the drawings. In the present specification, image data that becomes a target for processing by a computer is also simply referred to as an "image." As shown in FIG. 1, a sewing system 30 is provided with a sewing machine 10 and a sewing data generation device 20 (hereinafter referred to as the "device 20"). The sewing machine 10 is configured to perform embroidery sewing. The device 20 is a well-known personal computer (PC). The device 20 is provided with a display portion 9, a mouse 21 and a keyboard 22.

Physical Configurations of Sewing Machine 10 and Embroidery Frame 45

As shown in FIG. 1, the sewing machine 10 is provided with a bed portion 11, a pillar 12, an arm portion 13, a head portion 14 and a movement portion 40. The bed portion 11 is a base portion of the sewing machine 10 and extends in the left-right direction. The pillar 12 is provided in a standing condition and extends upward from the right end portion of the bed portion 11. A liquid crystal display (hereinafter also referred to as an LCD) 15 and a touch panel 26 are provided on the front surface of the pillar 12. The arm portion 13 faces the bed portion 11 and extends to the left from the upper end of the pillar 12. The head portion 14 is a portion coupled to the left leading end portion of the arm portion 13. The head portion 14 is provided with a sewing portion 50. Although not shown in the drawings, the sewing portion 50 includes a needle bar, a presser bar, a needle bar up-and-down movement mechanism and the like. A sewing needle is detachably mounted on the lower end of the needle bar. The sewing portion 50 causes the needle bar to move up and down.

The movement portion 40 is configured such that it can relatively move a sewing object C, which is held by the embroidery frame 45, with respect to the needle bar. The movement portion 40 is provided with a main body case 41 and a carriage 42. When embroidery sewing is performed, a user mounts the embroidery frame 45 on the carriage 42. The embroidery frame 45 is moved by a Y direction movement mechanism (not shown in the drawings) housed in the carriage 42 and an X direction movement mechanism (not shown in the drawings) housed in the main body case 41. A control portion 6 controls the sewing portion 50 and the movement portion 40 in accordance with sewing data. The sewing data includes coordinates expressed using an XY coordinate system (an embroidery coordinate system) that is unique to the sewing machine 10. The sewing data indicates a movement amount of the embroidery frame 45 with respect to the needle bar. The needle bar on which the sewing needle has been mounted, and a shuttle mechanism (not shown in the drawings) are driven in accordance with the movement of the embroidery frame 45. Thus, an embroidery pattern is formed on the sewing object C. The X direction and the Y direction in the embroidery coordinate system of the present example respectively correspond to the left-right direction and the front-rear direction of the sewing machine 10.

Electrical Configuration of Sewing Machine 10

Electrical configurations of the sewing system 30 will be explained sequentially with reference to FIG. 1. The sewing machine 10 is provided with a CPU 61, a ROM 62, a RAM 63, a flash memory 64, an input/output (I/O) interface 66 and a communication I/F 67. The CPU 61 is connected to the ROM 62, the RAM 63, the flash memory 64, the I/O interface 66 and the communication I/F 67, via a bus 65. Drive circuits 71 to 74, the touch panel 26, a start/stop switch 29 and a detector 36 are connected to the I/O interface 66. The control portion 6 includes the CPU 61, the ROM 62 and the RAM 63. The control portion 6 controls the sewing portion 50 and the movement portion 40. The detector 36 is configured to detect that the embroidery frame 45 has been mounted on the movement portion 40, and is also configured to output a detection result corresponding to a type of the embroidery frame 45.

A sewing machine motor 81 is connected to the drive circuit 71. The drive circuit 71 drives the sewing machine motor 81 in accordance with a control signal from the CPU 61. The sewing machine motor 81 drives the needle bar up-and-down movement mechanism (not shown in the drawings) via a drive shaft (not shown in the drawings) of the sewing machine 10. When the needle bar up-and-down movement mechanism is driven, the needle bar moves up and down. An X motor 83 is connected to the drive circuit 72. A Y motor 84 is connected to the drive circuit 73. The drive circuits 72 and 73 drive the X motor 83 and the Y motor 84, respectively, in accordance with a control signal from the CPU 61. When the X motor 83 and the Y motor 84 are driven, the embroidery frame 45 mounted on the movement portion 40 moves in the left-right direction (the X direction) and the front-rear direction (the Y direction) by a movement amount corresponding to the control signal. The drive circuit 74 causes an image to be displayed on the LCD 15 in accordance with a control signal from the CPU 61. An image including various items, such as commands, illustrations, setting values and messages etc., is displayed on the LCD 15. The touch panel 26 is provided on the front surface of the LCD 15. The user performs a pressing operation on the touch panel 26 (hereinafter, this operation is referred to as a "panel operation") using either a finger or a stylus pen. In the present embodiment, in correspondence with a pressed position detected by the touch panel 26, the CPU 61 recognizes the item selected by the panel operation. Using the touch panel 26, the user can select a pattern from among patterns displayed on the LCD 15, set various parameters, and perform an input operation etc. The communication I/F 67 connects the sewing machine 10 to a network 16. Thus, the CPU 61 can transmit and receive data to and from another device (for example, the device 20) connected to the network 16.

Electrical Configuration of Device 20

As shown in FIG. 1, the device 20 is provided with a CPU 1, a ROM 2, a RAM 3, a flash memory 4, a communication I/F 5 and an input/output interface 8. A control portion 23 includes the CPU 1, the ROM 2 and the RAM 3. The control portion 23 performs overall control of the device 20. The CPU 1 is electrically connected to the ROM 2, the RAM 3, the flash memory 4, the communication I/F 5 and the input/output interface 8, via a bus 7. A boot program and a BIOS and the like are stored in the ROM 2. Temporary data is stored in the RAM 3. Various setting values are stored in the flash memory 4. The communication I/F 5 is an interface to connect the device 20 to the network 16. The CPU 1 can transmit and receive data to and from another device (for example, the sewing machine 10) connected to the network 16. The input/output interface 8 is connected to the display portion 9, the mouse 21 and the keyboard 22. The display portion 9 is a liquid crystal display. The mouse 21 and the keyboard 22 are used when the user inputs various commands.

Outline of Main Processing Performed by Sewing System 30

An outline of main processing that is performed by the sewing system 30 will be explained. Each of the sewing machine 10 and the device 20 can perform the main processing. When the main processing is performed, the sewing data are generated. The sewing data are data to form a plurality of stippling patterns inside an area (hereinafter also referred to as a "target area") in which patterns are to be arranged. The target area is, for example, an area on the sewing object C. In the main processing, there is a case in which the target area is larger than an area (hereinafter also referred to as a sewing area) in which a pattern is to be sewn. In this case, the target area is divided by meandering boundary lines. Stitch paths of the stippling patterns are set in each of the divided areas. Of the plurality of stitch paths, two of the stitch paths that are adjacent are a first path and a second path. In a specific example to be described later, boundary lines 53 and 54 are set (refer to FIG. 5), and stitch paths 95 to 98 are created. For example, the stitch paths 95 and 96 correspond to the first path and the second path. When the sewing data are generated by the sewing machine 10, the control portion 6 acquires the sewing area and the target area. In the main processing, each of the plurality of sewing data is data to form stitches of the stippling pattern on the stitch path having a size that is contained within the sewing area acquired by the control portion 6. Of the plurality of stitch paths represented by the plurality of sewing data, the first path and the second path that is adjacent to the first path are separated from each other. Each of the first path and the second path is provided with a convex portion. Positions of the convex portions of the first path and the second path are the same as each other in an adjacent direction in which the first path and the second path in the target area are adjacent to each other. The control portion 6 associates and outputs the sewing data and arrangement information, for each of the plurality of generated sewing data. The arrangement information is information representing the arrangement, with respect to the target area, of the stippling patterns to be sewn based on the sewing data. It is sufficient that each of the plurality of sewing data be data to sew the stippling pattern inside one sewing area. Each of the sewing data may be divided by data indicating a sewing stop, for example, and then the plurality of sewing data may be combined as one data set. Although the generated data is one data set, this case is included in the case in which the plurality of sewing data of the present example are generated.

Main Processing Performed by Sewing Machine 10

Figure 2:
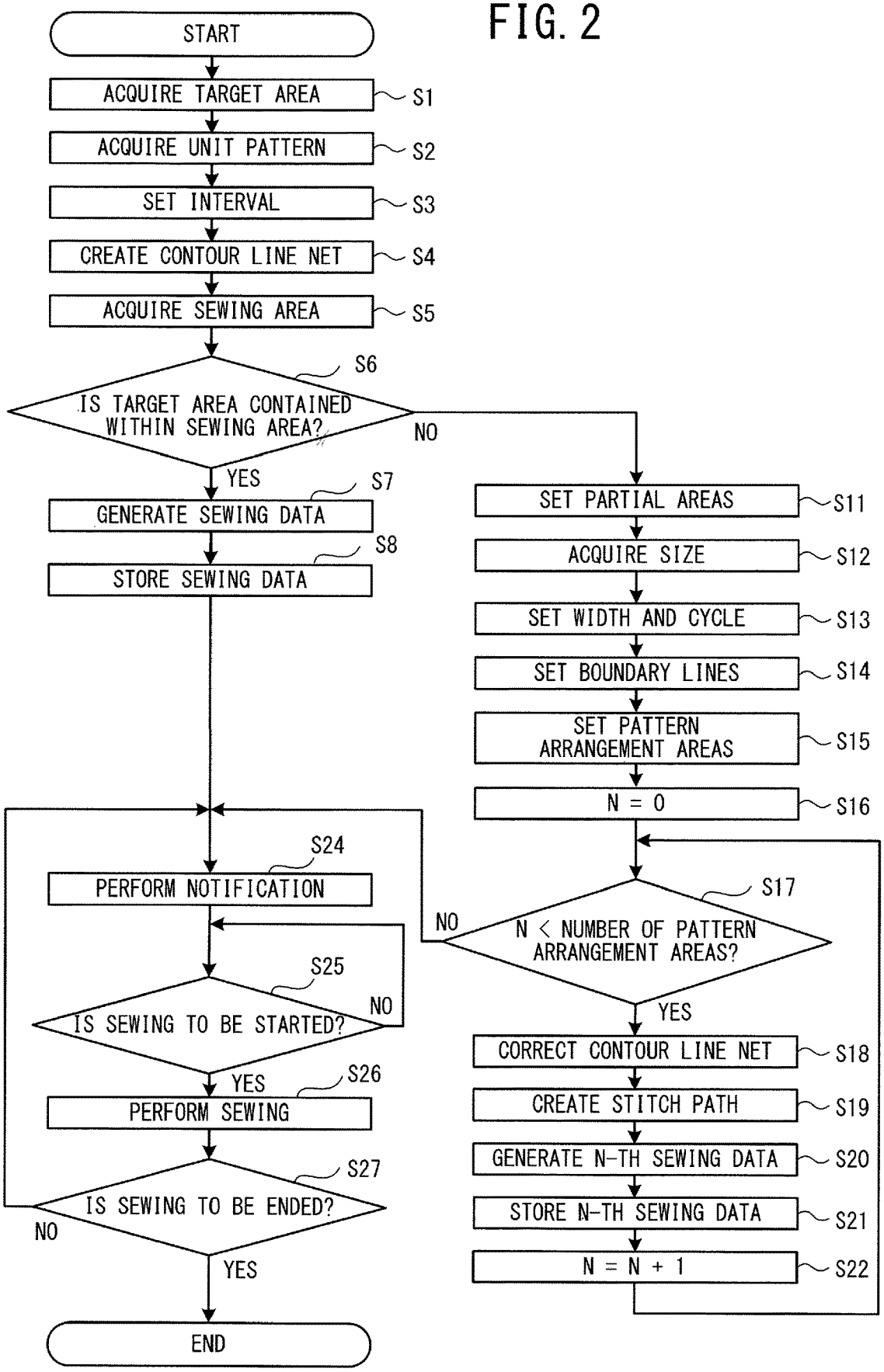
FIG. 2 is a flowchart of main processing that is performed by the sewing machine 10.

The main processing will be explained with reference to FIG. 2 to FIG. 7, taking, as an example, a case in which the main processing is performed by the sewing machine 10. The main processing performed by the sewing machine 10 includes processing that sews the stippling pattern in accordance with the generated sewing data, in addition to processing that generates the sewing data. In the processing that sews the stippling pattern, stitches of the stippling pattern are formed on the sewing object C held by the embroidery frame 45. When the main processing is performed by the device 20, the processing that sews the stippling pattern in accordance with the sewing data is not performed. When a start command is input by the panel operation, the main processing shown in FIG. 2 is performed. When the start command is input, the control portion 6 reads out a sewing data generation program stored in the flash memory 64, to the RAM 63. The control portion 6 performs the main processing in accordance with instructions included in the sewing data generation program.

As shown in FIG. 2, the control portion 6 acquires the target area in which patterns are to be arranged (step S1). The target area of the present example is represented by a graphic of the embroidery coordinate system. The target area may have any shape, such as a rectangle, a circle, a heart shape and the like. For example, the control portion 6 acquires the target area input by the panel operation. In the specific example, the target area is a rectangle having sides extending in the X direction and sides extending in the Y direction. In summary, in the specific example, the control portion 6 acquires the rectangular target area.

The control portion 6 acquires a unit pattern (step S2). The unit pattern has a predetermined shape. The unit pattern is a pattern that is used as a reference when the stitch path of the stippling pattern is set. The unit pattern of the present example is a graphic that can be continuously arranged without a gap on a two-dimensional image. More specifically, the unit pattern of the present example is a polygonal graphic. The unit pattern is, for example, an isosceles triangle, an equilateral triangle, a diamond shape, a parallelogram, a square, a regular hexagon, or the like. The unit pattern may be a pattern set in advance and stored in a storage device, such as the flash memory 64. The unit pattern may be a pattern specified by the user. The unit pattern may be a pattern specified by the user from among a plurality of types of patterns stored in a storage device, such as the flash memory 64. The unit pattern may be a pattern automatically selected in correspondence with the size of the target area, or the like. In the specific example, the control portion 6 acquires a regular hexagon as the unit pattern.

The control portion 6 sets an interval between two curved sections that are positioned close to each other in the stitch path of the stippling pattern to be arranged in the target area (step S3). It is believed that the stippling pattern is not attractive when the two closely-positioned curved sections included in the stitch path are too close to each other, and when the two closely-positioned curved sections included in the stitch path are too far apart from each other. The interval set at step S3 is set so that the stitch paths of the stippling patterns are arranged in a well-balanced manner in the target area acquired at step S1. The interval is represented by a numerical value in units of millimeters, for example. The interval is input by the panel operation, for example. The control portion 6 sets the input value as the interval. The interval may be a value that is automatically set corresponding to the type of the unit pattern, the size of the target area and the like, or may be a predetermined value.

Figure 3:
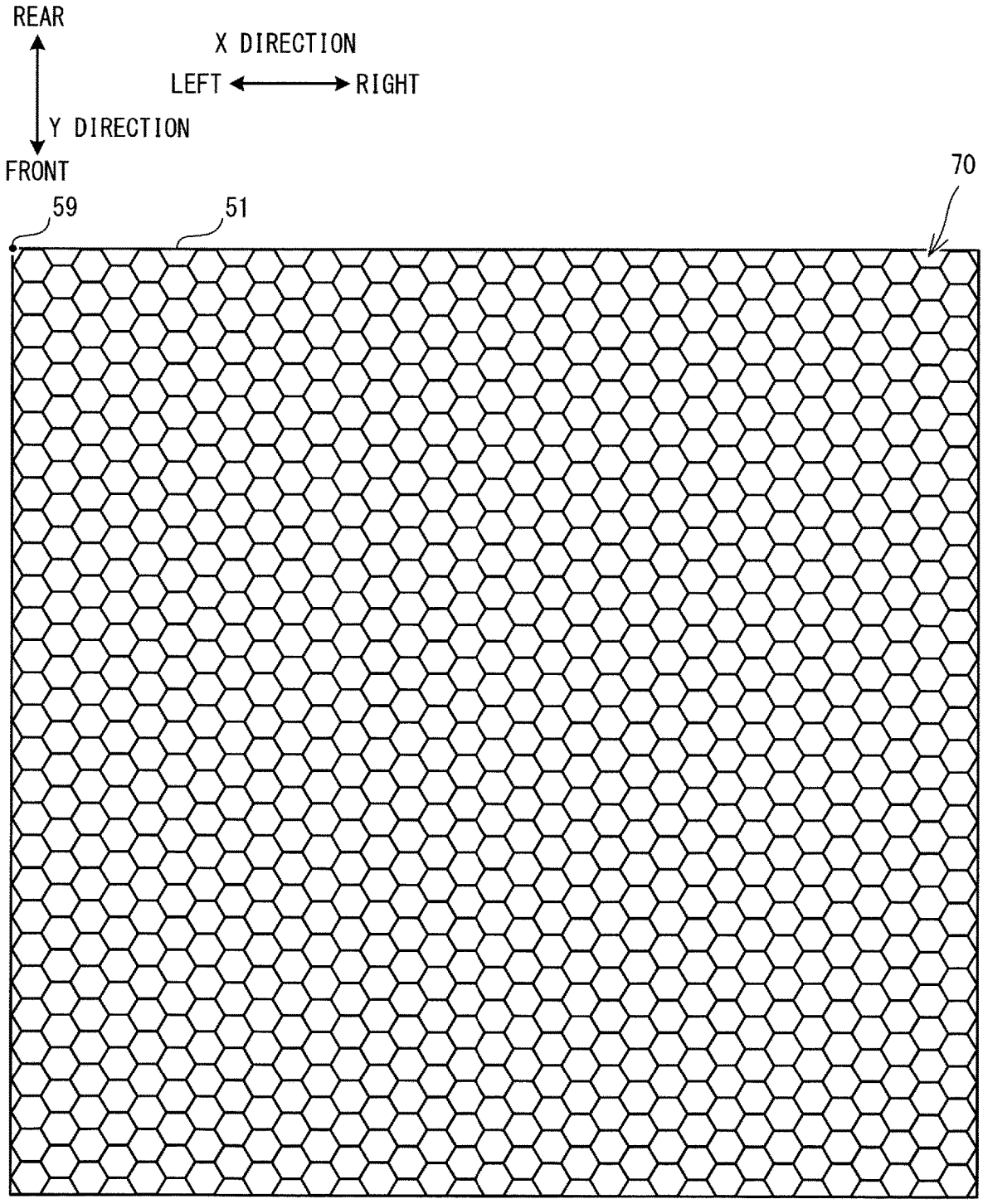
FIG. 3 is a diagram showing a state in which unit patterns are continuously arranged in a rectangular target area 51.

The control portion 6 creates a contour line net to create the stitch path of the stippling pattern (step S4). The contour line net is a group of the contour lines of the unit patterns and has a mesh-like shape (refer to FIG. 3). The control portion 6 continuously arranges the unit patterns each having the predetermined shape acquired at step S2 and having a size corresponding to the interval of the stitch path set at step S3, over the whole of the target area acquired at step S1. In this way, the control portion 6 creates the contour line net (step S4). A relationship between the value of the interval of the stitch path and the size of the unit pattern is stored in a storage device, such as the flash memory 64. In the specific example, the length of the unit pattern in the longitudinal direction is the interval set by the processing at step S3. As shown in FIG. 3, the regular hexagonal unit pattern corresponding to the interval set at step S3 is continuously arranged in a target area 51. Each of the unit patterns is continuously arranged in a mesh shape without a gap therebetween, in a posture in which two sides of the six sides of the regular hexagon extend in the X direction of the sewing machine 10, which corresponds to the left-right direction of the target area. Thus, a contour line net 70 formed from a group of the contour lines of the regular hexagons is created.

The control portion 6 acquires the sewing area (step S5). The sewing area is an area set inside the embroidery frame 45, and is an area in which stitches can be formed by the sewing machine 10 on which the embroidery frame 45 has been mounted. The sewing area of the present example is a rectangular area having sides extending in the X direction and sides extending in the Y direction. The control portion 6 of the present example identifies the type of the embroidery frame 45 on the basis of a detection result by the detector 36, and acquires the sewing area corresponding to the identified type of the embroidery frame 45. A relationship between the type of the embroidery frame 45 and the size of the sewing area is stored in advance in the flash memory 64. When only one type of the embroidery frame 45 can be mounted on the movement portion 40, the control portion 6 may acquire the sewing area corresponding to the type of the embroidery frame 45. The control portion 6 may acquire a value input by the panel operation, as the sewing area. In the specific example, the control portion 6 acquires a rectangular sewing area 52 shown in FIG. 4, on the basis of the type of the embroidery frame 45. The sewing area 52 is smaller than the target area 51.

The control portion 6 determines whether the target area 51 acquired at step S1 is contained within the sewing area 52 acquired at step S5 (step S6). When the target area 51 is contained within the sewing area 52 (yes at step S6), the control portion 6 generates the sewing data (step S7). The control portion 6 generates the sewing data using a known method (for example, a method described in Japanese Laid-Open Patent Publication No. 2008-136623). Specifically, the control portion 6 creates the stitch path by connecting vertices on the contour line net using a curved line without intersection, and generates the sewing data to form stitches of a predetermined pitch on the created stitch path. The control portion 6 stores the sewing data generated by the processing at step S7 in the RAM 63 (step S8).

Figure 4:
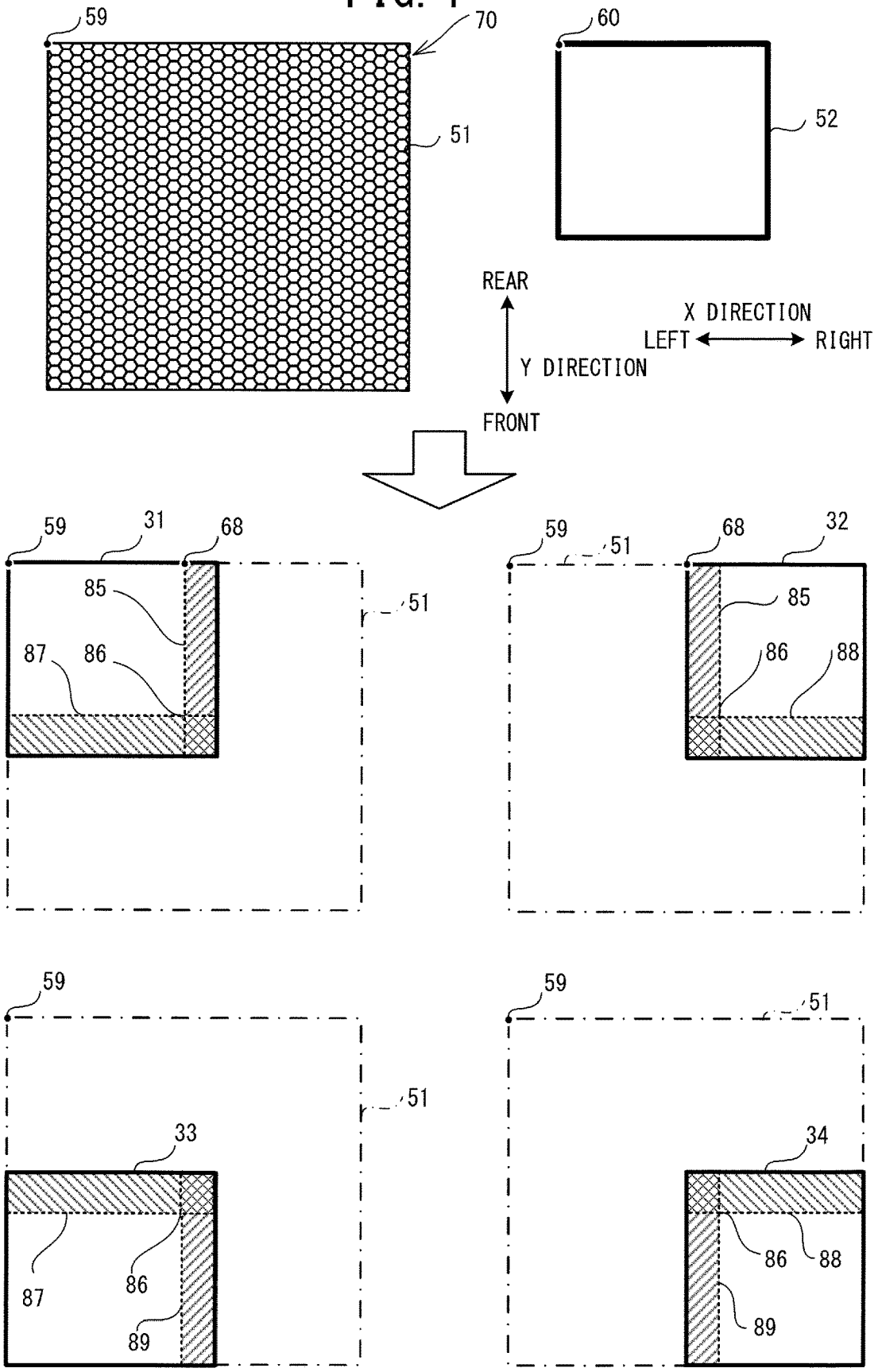
FIG. 4 is an explanatory diagram of processing that sets a plurality of partial areas 31 to 34 having a size that is contained within the target area 51.

As in the specific example shown in FIG. 4, when the target area 51 is not contained within the sewing area 52 (no at step S6), the control portion 6 sets a plurality of partial areas inside the target area 51 acquired by the processing at step S1 (step S11). Each of the plurality of partial areas is an area that does not exceed the size of the sewing area 52 acquired by the processing at step S5. Adjacent partial areas of the plurality of partial areas include an overlapping area in which they overlap with each other. The larger the number of the partial areas, the greater the operation to change the arrangement of the sewing object C with respect to the embroidery frame 45, in comparison to when the number of the partial areas is relatively small. For that reason, it is preferable that the number of the partial areas be as few as possible. The overlapping areas are set while taking account of conditions under which the boundary lines (which will be described later) can be set. The partial areas of the present example are areas obtained by dividing the target area acquired by the processing at step S1, using line segments that extend in the X direction or the Y direction. When the target area is a rectangle having the sides extending in the X direction and the sides extending in the Y direction, each of the partial areas is also a rectangle having the sides extending in the X direction and the sides extending in the Y direction. In this case, each of the overlapping areas is a rectangle that extends in the X direction and the Y direction. Any area included in the target area 51 acquired by the processing at step S1 is included in at least one of the plurality of partial areas.

In the specific example, as shown in FIG. 4, the control portion 6 generates four partial areas 31 to 34 in the target area 51. Each of the partial areas 31 to 34 is a rectangular area having a size that is contained within the sewing area 52. The partial areas 31 and 33 have the same size as the sewing area 52. The size of the partial areas 32 and 34 in the Y direction is the same as the size of the sewing area 52 in the Y direction. The size of the partial areas 32 and 34 in the X direction is different from the size of the sewing area 52 in the X direction, and in the present example, is smaller than the size of the sewing area 52 in the X direction. The four partial areas 31 to 34 partially overlap with each other. For example, the partial area 31 includes an overlapping area 85 shown by diagonal line hatching and an overlapping area 86 shown by diagonal grid hatching. The overlapping area 85 overlaps with a part of the partial area 32. The partial area 31 includes the overlapping area 86 that overlaps with a part of the partial area 33, and an overlapping area 87 shown by diagonal line hatching. The partial area 31 includes the overlapping area 86 that overlaps with a part of the partial area 34. The partial area 34 includes the overlapping area 86 that overlaps with a part of the partial area 32, and an overlapping area 88 shown by diagonal line hatching. The partial area 34 includes the overlapping area 86 that overlaps with a part of the partial area 33, and an overlapping area 89 shown by diagonal line hatching. The target area 51 acquired by the processing at step S1 can be represented by the four partial areas 31 to 34. The overlapping areas 85 to 89 of the present example are each set in the following manner, while taking account of the conditions under which the boundary lines (which will be described later) can be set in the overlapping areas. The width of the overlapping areas 85, 86 and 89 in the X direction is set to be equal to or larger than the width of the boundary line that extends in the Y direction and meanders in the X direction. The width of the boundary line that extends in the Y direction and meanders in the X direction is the length of a meandering range of the boundary line in the X direction. In the specific example, the width of the overlapping areas 85, 86 and 89 in the X direction is 3.0 times the width of the boundary line in the X direction. The width of the overlapping areas 86 to 88 in the Y direction is set to be equal to or larger than the width of the boundary line that extends in the X direction and meanders in the Y direction. The width of the boundary line that extends in the X direction and meanders in the Y direction is the length of a meandering range of the boundary line in the Y direction. In the specific example, the width of the overlapping areas 86 to 88 in the Y direction is 2.0 times the width of the boundary line in the Y direction.

The control portion 6 acquires the size of the unit pattern arranged at step S4 (step S12). The size of the unit pattern acquired at step S12 is used in the setting of the boundary lines to be described later. The size of the unit pattern is represented by, for example, the length of sides of a minimum rectangle that encompasses the unit pattern. The sides of the minimum rectangle are sides extending in the X direction and sides extending in the Y direction. The control portion 6 acquires the size of the unit pattern in the X direction and the size of the unit pattern in the Y direction. The unit pattern of the present example is the regular hexagon, and is arranged in the posture in which two sides of the six sides of the regular hexagon extend in the X direction. Therefore, the length of the unit pattern in the X direction is longer than the length of the unit pattern in the Y direction.

The control portion 6 sets the width of each of the boundary lines and a cycle of each of the boundary lines, in correspondence with the size acquired at step S12 (step S13). The boundary lines are lines to divide the target area acquired by the processing at step S1 into areas of the number of the partial areas set by the processing at step S11. Each of the boundary lines meanders in an adjacent direction. The adjacent direction is a direction in which the first path and the second path, which will be described later, are adjacent to each other. The adjacent direction of the stitch paths set for the partial areas 31 and 32 is the X direction. That is, the adjacent direction is also a direction in which the partial areas 31 and 32 are adjacent to each other. The width of the boundary line is the length of the boundary line in the adjacent direction. The width of the boundary line of the present example is set such that the larger the size of the unit pattern acquired at step S12, the larger the width of the boundary line, in comparison to when the size is relatively small. The boundary line of the present example meanders cyclically with the same rule in a boundary direction orthogonal to the adjacent direction. The cycle of the boundary line indicates the length in the boundary direction of the boundary line corresponding to one cycle. The cycle of the boundary line of the present example (namely, a meandering cycle of the boundary line) is set such that the larger the size of the unit pattern acquired at step S12, the larger the cycle, in comparison to when the size is relatively small. Relationships between the size of the unit pattern, and the width of the boundary line and the cycle of the boundary line are stored in advance in the flash memory 64. The control portion 6 sets the value of the width of the boundary line and the value of the cycle of the boundary line such that the boundary line extending in the X direction is longer than the boundary line extending in the Y direction. The control portion 6 of the present example uses, as the reference, the size of the unit pattern corresponding to the interval set by the processing at step S3, and thus sets the width of each of the boundary lines and the cycle of each of the boundary lines. The control portion 6 of the present example sets the width of the boundary line extending in the Y direction to be 1.0 times the size of the unit pattern in the X direction, and sets the cycle of the boundary line to be 5.0 times the size of the unit pattern in the Y direction. The control portion 6 sets the width of the boundary line extending in the X direction to be 1.5 times the size of the unit pattern in the Y direction, and sets the cycle of the boundary line to be 10.5 times the size of the unit pattern in the X direction. The width of each of the boundary lines and the cycle of each of the boundary lines need not necessarily be set using the size of the unit pattern as the reference.

The control portion 6 sets the boundary lines meandering in the adjacent direction inside the overlapping areas of the partial areas set at step S11 (step S14). The control portion 6 of the present example sets the boundary lines meandering in the adjacent direction inside the overlapping areas, in accordance with the shape of the continuously arranged unit patterns. More specifically, the control portion 6 sets each of the boundary lines by connecting the centers of the continuously arranged unit patterns. It is sufficient that the boundary line be a line that meanders in the adjacent direction. The boundary line may be a line formed by connecting a plurality of line segments at a predetermined angle, may be a line formed by connecting a straight line and a curved line, or may be a line formed by connecting a plurality of curved lines.

As shown in FIG. 5, in the specific example, the control portion 6 sets the boundary lines 53 and 54, which are formed by line segments obtained by connecting the centers of the continuously arranged unit patterns, inside the overlapping areas 85 to 89. A part of the boundary line 53 and a part of the boundary line 54 overlap with each other in the overlapping area 86. The boundary line 53 is a line extending in the X direction. The boundary line 53 is arranged in the overlapping areas 86 and 87 of the partial areas 31 and 33, and in the overlapping areas 86 and 88 of the partial areas 32 and 34. A width W1 of the boundary line 53 is 1.5 times the size of the unit pattern in the Y direction. A cycle C1 of the boundary line 53 is 10.5 times the size of the unit pattern in the X direction. The boundary line 54 is a line extending in the Y direction. The boundary line 54 is arranged in the overlapping areas 85 and 86 of the partial areas 31 and 32, and in the overlapping areas 86 and 89 of the partial areas 33 and 34. A width W2 of the boundary line 54 is 1.0 times the size of the unit pattern in the X direction. A cycle C2 of the boundary line 54 is 5.0 times the size of the unit pattern in the Y direction. The width W1 is longer than the width W2. The cycle C1 is longer than the cycle C2. The width W1, the width W2, the cycle C1, the cycle C2, and the meandering rule in each cycle may be changed as appropriate.

The control portion 6 sets a plurality of pattern arrangement areas, each of which does not exceed the size of the sewing area acquired at step S5, inside the target area acquired at step S1 (step S15). The control portion 6 of the present example sets the pattern arrangement area for each of the partial areas 31 to 34. More specifically, the control portion 6 sets, as the pattern arrangement area, a side, in the partial area, that is closer to the center of each of the partial areas than the boundary line set in the overlapping area of the partial areas by the processing at step S14 (step S15).

As shown in FIG. 5, in the specific example, four pattern arrangement areas 55 to 58 are set inside the target area 51. Any area included in the target area 51 acquired by the processing at step S1 is included in one of the plurality of pattern arrangement areas 55 to 58. The pattern arrangement area 55 is an area further to a center 75 side, in the partial area 31, than the boundary lines 53 and 54. The pattern arrangement area 56 is an area further to a center 76 side, in the partial area 32, than the boundary lines 53 and 54. The pattern arrangement area 57 is an area further to a center 77 side, in the partial area 33, than the boundary lines 53 and 54. The pattern arrangement area 58 is an area further to a center 78 side, in the partial area 34, than the boundary lines 53 and 54. The adjacent direction of the pattern arrangement areas 55 and 56 is the X direction, and the boundary line 54 of the pattern arrangement areas 55 and 56 meanders in the X direction. The adjacent direction of the pattern arrangement areas 57 and 58 is the X direction, and the boundary line 54 of the pattern arrangement areas 57 and 58 meanders in the X direction. The adjacent direction of the pattern arrangement areas 55 and 57 is the Y direction, and the boundary line 53 of the pattern arrangement areas 55 and 57 meanders in the Y direction. The adjacent direction of the pattern arrangement areas 56 and 58 is the Y direction, and the boundary line 53 of the pattern arrangement areas 56 and 58 meanders in the Y direction.

The control portion 6 sets a variable N to 0 (step S16). The variable N is a number to sequentially read out the plurality of pattern arrangement areas 55 to 58. In the specific example, the N-th pattern arrangement area (N=0, 1, 2, 3) corresponds to the pattern arrangement areas 55 to 58. The 0-th pattern arrangement area corresponds to the pattern arrangement area 55. Similarly, the three first to third pattern arrangement areas correspond to the pattern arrangement areas 56 to 58, respectively. The control portion 6 determines whether the variable N is smaller than the total number 4 of the pattern arrangement areas (step S17). When the variable N is 0, the variable N is smaller than the total number 4 of the pattern arrangement areas (yes at step S17). In this case, the control portion 6 corrects a section, of the contour line net 70 in the N-th pattern arrangement area, that faces the boundary line (step S18). The control portion 6 moves the specific vertices 79 toward the boundary line side. Each of the specific vertices 79 is one of the vertices of the polygons represented by the contour line net 70 created at step S4. Each of the specific vertices 79 face the boundary line. Hereinafter the specific vertices 79 which have been moved toward the boundary line side are referred as "moved vertices 99". A movement amount of the specific vertices 79 at step S18 may be set, as appropriate, depending on a distance by which the boundary line and the specific vertices 79 are separated from each other. The movement amount is, for example, 5 to 40 percent of the length of the unit pattern in the adjacent direction. When the processing at step S18 is performed for the 0-th pattern arrangement area 55 and the first pattern arrangement area 56, the control portion 6 moves the specific vertices 79 toward the boundary line 54 side, as partially shown in FIG. 6. In the specific example, as partially shown in FIG. 6, facing line segments that face the boundary line 54 are shown by thick line segments, and the vertices on the facing line segments are moved vertices 99. In the FIG. 6, the contour line net 70 in the left side is the contour line net 70 that is to be corrected, and the contour line net 70 in the right side is the corrected contour line net 70.

The control portion 6 creates the stitch path of the stippling pattern inside the N-th pattern arrangement area set as the processing target (step S19). The control portion 6 creates the stitch path, on the basis of the path connected without intersection on the contour line net 70 created by the processing at step S4 and corrected by the processing at step S18 (step S19). The control portion 6 of the present example creates the stitch path by connecting the vertices on the contour line net 70 within the N-th pattern arrangement area, using a curved line without intersection. The control portion 6 of the present example creates the stitch path 95. The stitch path 95 is obtained by connecting the moved vertices 99 using a curved line without intersection. The stitch path created in the pattern arrangement area is a closed path represented by a single line. The closed path indicates, in addition to a path whose start point and end point are at the same position, a path including mutually overlapping portions between the start point and the end point. The stippling pattern may be a pattern in which a plurality of open and closed lines are mixed such that the area is filled with stitches. The stitch path need not necessarily be a closed path represented by a single line. The control portion 6 of the present example creates the stitch path by connecting the vertices on the contour line net 70 within the pattern arrangement area divided by the boundary lines meandering in the adjacent direction, using a curved line without intersection. Thus, the stitch path is created to fall within a predetermined range including the interval between the two closely-positioned curved sections in the stitch path of the stippling pattern set by the processing at step S3. The predetermined range may be set as appropriate and is, for example, a range that is 0.5 to 1.5 times the interval set by the processing at step S3. As the method for setting the stitch path in the pattern arrangement area, a known method (for example, the method described in Japanese Laid-Open Patent Publication No. 2008-136623) may be adopted, as appropriate. The control portion 6 creates the stitch path 95 for the pattern arrangement area 55 such that the stitch path 95 passes through, as much as possible, the moved vertices 99 on the contour line net 70 corrected by the processing at step S18 and the vertices that face the contour line of the target area 51.

In the specific example, each time the processing at step S19 is repeatedly performed, the control portion 6 sets the stitch paths 95 to 98 inside the pattern arrangement areas 55 to 58, respectively, as shown in FIG. 7. The stitch paths 95 to 98 are separated from each other. Each of the stitch paths 95 to 98 is separated from the boundary lines 53 and 54. In each of the stitch paths 95 to 98, the distance between chosen two of the closely-positioned curved sections in the stitch path falls within the predetermined range including the interval set at step S3, as shown by distances D1 to D4. Each of the stitch paths 95 to 98 is a closed path represented by a single line. Each of the stitch paths 95 to 98 has no intersection point, excluding the start point and the end point.

Combinations of the stitch paths that are adjacent in the X direction will be explained. The stitch path 96 is adjacent to the stitch path 95 in the X direction. The stitch path 95 and the stitch path 96 are separated from each other. The stitch path 95 has convex portions T1 and the stitch path 96 has convex portions T2. Positions of the convex portions T1 and T2 in the adjacent direction (the X direction), in which the stitch path 95 and the stitch path 96 are adjacent to each other, are the same as each other. Among convex portions included in the stitch path 95, the convex portion T1 is a portion whose position in the X direction is within a range W4. The range W4 indicates a range of a section in which the positions of the stitch path 95 and the stitch path 96 in the adjacent direction (the X direction) are the same as each other. The range W4 is a range that is defined by the end (the right end) on the stitch path 96 side of the stitch path 95 and the end (the left end) on the stitch path 95 side of the stitch path 96. The convex portion T1 protrudes toward the stitch path 96. Among convex portions included in the stitch path 96, the convex portion T2 is a portion whose position in the X direction is within the range W4. The convex portion T2 protrudes toward the stitch path 95. The convex portions T1 and T2 are portions that are set on the basis of the moved vertices 99 on the contour line net 70 corrected at step S18. In the processing at step S19 of the present example, the stitch path 95 is created such that it passes through, as much as possible, the moved vertices 99 on the contour line net 70 corrected by the processing at step S18. The convex portions T1 and T2 are arranged along the shape of the boundary line 54. The convex portions T1 and T2 are arranged cyclically in the boundary direction (the Y direction). When a line that defines an extending range of the stitch path 95 and an extending range of the stitch path 96 is set inside the target area 51, the set line is a line including curved sections, and a straight line that is not in contact with both the stitch paths 95 and 96 cannot be set. More specifically, in any area within the range W4 inside the overlapping area 85, if a straight line is set in the boundary direction (the Y direction), the set straight line intersects both the stitch paths 95 and 96. When a convex hull, which is a smallest convex set including the stitch path 95, is set, the number of the convex portions of the stitch path 95 in contact with the set convex hull is smaller in a right portion that faces the boundary line 54, in comparison to a left portion that faces a part of the contour of the rectangular target area 51, by a predetermined ratio (for example, 30 to 70 percent). Similarly, the number of the convex portions of the stitch path 95 in contact with the set convex hull is smaller in a front portion that faces the boundary line 53, in comparison to a rear portion that faces a part of the contour of the rectangular target area 51, by the predetermined ratio (for example, 30 to 70 percent). Similarly, the stitch path 97 and the stitch path 98 that is adjacent to the stitch path 97 in the X direction are separated from each other. The stitch path 97 has convex portions T3 and the stitch path 98 has convex portions T4. Positions of the convex portions T3 and T4 in the adjacent direction (the X direction), in which the stitch path 97 and the stitch path 98 are adjacent to each other, are the same as each other.

Combinations of the stitch paths that are adjacent in the Y direction are similar to the above-described combinations. The stitch path 97 is adjacent to the stitch path 95 in the Y direction. The stitch path 95 and the stitch path 97 are separated from each other. The stitch path 95 has convex portions T5 and the stitch path 97 has convex portions T6. Positions of the convex portions T5 and T6 in the adjacent direction (the Y direction), in which the stitch path 95 and the stitch path 97 are adjacent to each other, are the same as each other. Among the convex portions included in the stitch path 95, the convex portion T5 is a portion whose position in the Y direction is within a range W3. The range W3 indicates a range of a section in which the positions of the stitch path 95 and the stitch path 97 in the adjacent direction (the Y direction) are the same as each other. The range W3 is a range that is defined by the end (the front end) on the stitch path 97 side of the stitch path 95 and the end (the rear end) on the stitch path 95 side of the stitch path 97. The convex portion T5 protrudes toward the stitch path 97. Among convex portions included in the stitch path 97, the convex portion T6 is a portion whose position in the Y direction is within the range W3. The convex portion T6 protrudes toward the stitch path 95. The convex portions T5 and T6 are arranged along the shape of the boundary line 53. The convex portions T5 and T6 are arranged cyclically in the boundary direction (the X direction). When a line that defines the extending range of the stitch path 95 and an extending range of the stitch path 97 is set inside the target area 51, the set line is a line including curved sections, and a straight line that is not in contact with both the stitch paths 95 and 97 cannot be set. More specifically, in any area within the range W3 inside the overlapping area 87, if a straight line is set in the boundary direction (the X direction), the set straight line intersects both the stitch paths 95 and 97. Similarly, the stitch path 96 and the stitch path 98 that is adjacent to the stitch path 96 in the Y direction are separated from each other. The stitch path 96 has convex portions T7 and the stitch path 98 has convex portions T8. Positions of the convex portions T7 and T8 in the adjacent direction (the Y direction), in which the stitch path 96 and the stitch path 98 are adjacent to each other, are the same as each other. The length of the range W3 of the convex portions in the adjacent direction when the adjacent direction is the Y direction is larger than the length of the range W4 of the convex portions in the adjacent direction when the adjacent direction is the X direction.

The control portion 6 generates the sewing data (step S20). The generated sewing data is data to form the stitches of the stippling pattern on the stitch path set inside the pattern arrangement area by the processing at step S19. In the stitch path of the stippling pattern, the larger the interval of the stitch path set by the processing at step S3, the longer the length of the convex portion in the adjacent direction, in comparison to when the interval of the stitch path is relatively small. The control portion 6 arranges the convex portion cyclically in the boundary direction orthogonal to the adjacent direction. Thus, the larger the interval of the stitch path set by the processing at step S3, the longer an interval at which the convex portions are arranged in the boundary direction, in comparison to when the interval of the stitch path is relatively small.

The control portion 6 sets the N-th pattern arrangement area in the sewing area acquired at step S5, for example. The sewing data generated by the control portion 6 indicates positions to form stitches of a running stitch of a predetermined pitch on the stitch path set at step S19, using coordinates of the embroidery coordinate system. The method for arranging the pattern arrangement area with respect to the sewing area may be set as appropriate. The control portion 6 of the present example sets the pattern arrangement area in the sewing area, by aligning a rear left corner 60 of the sewing area 52 with the rear left corner of the partial area. The stitch pitch and the stitch type may be set as appropriate. At step S20, the sewing data to form stitches of the stippling pattern with a decorative pattern, for example, may be generated in accordance with a known method (for example, a method described in Japanese Laid-Open Patent Publication No. 2008-136624).

The control portion 6 associates the sewing data with the arrangement information for each of the sewing data generated at step S20 and outputs the sewing data and the arrangement information that have been associated with each other, to the flash memory 64 (step S21). The arrangement information indicates the arrangement of the stippling pattern to be sewn based on the sewing data, with respect to the target area. For example, the arrangement information may be information indicating the arrangement of the pattern arrangement areas or the partial areas with respect to the target area, and being represented by the embroidery coordinate system. The control portion 6 of the present example sets a sewing order in correspondence with the arrangement of the stitch paths (the pattern arrangement areas) in the target area. For example, in correspondence with the arrangement in the target area, the sewing order is set sequentially from the left to the right and from the rear to the front. In accordance with the sewing data, the control portion 6 of the present example causes the stitches representing the stitch path of the stippling pattern to be sequentially sewn on the sewing object C, from the stitch path 95 to the stitch path 98. Therefore, the control portion 6 uses, as the arrangement information, a predetermined sewing order and the information indicating the arrangement of the stitch paths with respect to the sewing area. The control portion 6 increments the variable N by 1 (step S22) and returns the processing to step S17.

At step S17 that is repeatedly performed, when the variable N is larger than 4, which is the number of the pattern arrangement areas (no at step S17), the control portion 6 performs processing to sew the stippling pattern on the sewing object C (step S24 to step S27). Specifically, the control portion 6 notifies the arrangement information of the next sewing data (step S24). When the sewing is performed in accordance with the sewing data representing the stitch path 95, which is the first stitch path in the sewing order, the control portion 6 causes the LCD 15 to display a first command, for example. The first command is a command to cause the sewing object C to be held by the embroidery frame 45 such that the rear left corner 60 (refer to FIG. 1)

of the sewing area 52 set inside the embroidery frame 45 is aligned with a corner 59 of the target area 51. When the sewing is performed in accordance with the sewing data representing the stitch path 96, which is the second stitch path in the sewing order, the control portion 6 causes the LCD 15 to display a second command, for example. The second command is a command to cause the sewing object C to be held by the embroidery frame 45 such that a rear left corner 68 of the partial area 32 is aligned with the rear left corner 60 of the sewing area 52 set inside the embroidery frame 45. In this case, the control portion 6 may cause the LCD 15 to display a part of the stitch path 95 in the vicinity of the corner 68, as an indication of the position of the corner 68 of the partial area 32. When the sewing machine 10 is provided with an image capture portion (for example, an image sensor) that can be used for positioning of the patterns, the positioning may be performed automatically in accordance with a known method (for example, a method described in Japanese Laid-Open Patent Publication No. 2012-228472). This also applies to a case in which stitches are formed on the third stitch path onward in the sewing order.

After the user has mounted the sewing object C on the embroidery frame 45 in accordance with the arrangement information, the user inputs a sewing start command through the panel operation. The control portion 6 determines whether the sewing start command has been acquired (step S25). The control portion 6 stands by until the sewing start command is acquired (no at step S25). When the sewing start command has been acquired (yes at step S25), the control portion 6 controls the movement portion 40 and the sewing portion 50 in accordance with the sewing data, and forms the stitches of the stippling pattern on the sewing object C. The control portion 6 determines whether the sewing has been performed in accordance with all the sewing data generated by the processing at step S8 or step S20 (step S27). When there is the sewing data for which the sewing has not been performed (no at step S27), the control portion 6 returns the processing to step S24 and performs the processing to perform the sewing in accordance with the sewing data for which the sewing has not been performed (step S24). When the sewing has been performed in accordance with all the generated sewing data (yes at step S27), the control portion 6 ends the main processing. In the specific example, a stippling pattern 69 is sewn by the main processing, as shown in FIG. 8. The stippling pattern 69 includes the stitch paths 95 to 98 and four stippling patterns 91 to 94 inside the target area 51 of the sewing object C. When the processing from step S1 to step S22 of the above-described main processing is performed by the device 20, the control portion 23 of the device 20 may output the generated sewing data to the sewing machine 10 via the network 16, or may output the generated sewing data to the sewing machine 10 via a storage device, such as a USB memory (not shown in the drawings).

Hereinafter, effects obtained when the processing to generate the sewing data is performed by the sewing machine 10 will be described. Similar effects are obtained when the processing to generate the sewing data is performed by the device 20. The sewing machine 10 can generate a plurality of the sewing data to form the stitches of the plurality of stippling patterns inside the target area 51. The first path and the second path are two adjacent stitch paths of the plurality of stitch paths 95 to 98. The first path and the second path are separated from each other. Therefore, when the stippling patterns are sewn in accordance with the sewing data, it is not necessary to align end portions of the divided stitches as in related art. The first path and the second path respectively have the convex portions whose positions in the adjacent direction inside the target area 51 are the same as each other. Therefore, when the stippling patterns are formed inside the target area 51 in accordance with the plurality of sewing data, as shown in FIG. 8, the boundaries between each of the stippling patterns 91 to 94 are less noticeable than when the convex portions whose positions in the adjacent direction inside the target area 51 are the same each other are not included. Therefore, even when the stippling pattern 69 is arranged in the target area 51 larger than the sewing area 52, the sewing machine 10 can generate the sewing data configured to form natural stitches.

The sewing machine 10 sets the interval between the two closely-positioned curved sections in the stitch path (step S3). In the stitch path of the stippling pattern, the larger the interval of the stitch path set by the processing at step S3, the longer the length of the convex portion in the adjacent direction, in comparison to when the interval of the stitch path is relatively small. Therefore, in the stitch path of the stippling pattern, the sewing machine 10 can increase the length of the convex portion in the adjacent direction in correspondence with the interval of the stitch path set by the processing at step S3. Therefore, in comparison to when the sewing data are generated under the same conditions regardless of the interval of the stitch path, the sewing machine 10 can generate the sewing data configured to form natural stitches that are appropriate for the interval of the stitch path.

The sewing machine 10 sets the interval between the two closely-positioned curved sections in the stitch path (step S3). When the processing at step S20 is performed, the sewing machine 10 arranges the convex portion cyclically in the boundary direction orthogonal to the adjacent direction. The larger the interval of the stitch path set by the processing at step S3, the longer the interval at which the convex portions are arranged in the boundary direction, in comparison to when the interval of the stitch path is relatively small. Therefore, in the stitch path of the stippling pattern, the sewing machine 10 can lengthen the interval at which the convex portions are arranged in the boundary direction, in correspondence with the interval of the stitch path. Therefore, in comparison to when the sewing data are generated under the same conditions regardless of the interval of the stitch path, the sewing machine 10 can generate the sewing data configured to form natural stitches that are appropriate for the interval of the stitch path.

Inside the target area acquired by the processing at step S1, the sewing machine 10 sets the plurality of pattern arrangement areas, each of which does not exceed the size of the sewing area acquired by the processing at step S5 (step S15). The sewing machine 10 creates the contour line net to create the stitch path (step S4). The contour line net is a group of the contour lines of the unit patterns. The unit patterns are continuously arranged in each of the plurality of pattern arrangement areas. The unit pattern has the predetermined shape with the size corresponding to the interval of the stitch path set at step S3. Through the processing at step S19 that is repeatedly performed, the sewing machine 10 creates the stitch path of the stippling pattern on the inside of each of the plurality of pattern arrangement areas, on the basis of the path connected without intersection on the generated contour line net (step S19). Through the processing at step S20 that is repeatedly performed, the sewing machine 10 generates the sewing data to form the stitches of the stippling pattern on the stitch path set on the inside of each of the pattern arrangement areas by the processing at step S19 (step S20). Thus, the sewing machine 10 can effectively set the stitch paths on the basis of the contour line net.

The sewing machine 10 sets the plurality of partial areas inside the target area acquired at step S1 (step S11). The plurality of partial areas are areas, each of which does not exceed the size of the sewing area acquired at step S5. The partial areas include the overlapping areas. The overlapping area overlaps with a part of another overlapping area that is adjacent to the partial area including the overlapping area. The sewing machine 10 sets the boundary lines meandering in the adjacent direction inside the overlapping areas (step S14). For each of the plurality of partial areas, the sewing machine 10 sets, as the pattern arrangement area, a side, in the partial area, that is closer to the center of the partial area than the boundary line set in the overlapping area of the partial areas (step S15). When the stippling patterns are respectively formed in the plurality of pattern arrangement areas within the target area, the boundary lines of each of the stippling patterns are less noticeable than when the meandering boundary lines are not set in the overlapping areas. Therefore, even when the stippling pattern is arranged in the target area larger than the sewing area, the sewing machine 10 can generate the sewing data configured to form natural stitches.

The sewing machine 10 creates the contour line net by continuously arranging the unit patterns, over the whole of the target area including the plurality of pattern arrangement areas (step S4). Each of the unit patterns has the size corresponding to the set interval, set at step S3, of the stitch path. The sewing machine 10 sets the boundary lines meandering in the adjacent direction inside the overlapping areas, in accordance with the predetermined shape of the continuously arranged unit patterns (step S14). The sewing machine 10 can set the boundary lines in accordance with the predetermined shape of the unit patterns. Therefore, in comparison to when the boundary lines are set regardless of the predetermined shape of the unit patterns, the sewing machine 10 can generate the sewing data configured to form natural stitches, in which the boundary of the adjacent stippling patterns is not noticeable.

The sewing machine 10 sets each of the boundary lines by connecting the centers of the continuously arranged unit patterns (step S14). The sewing machine 10 sets each of the boundary lines by connecting the centers of the unit patterns, and can create the stitch path on the basis of the contour line net of the area that is closer to the center of the pattern arrangement area than the boundary lines. The sewing machine 10 can appropriately create the boundary line that meanders in the direction orthogonal to the adjacent direction. Thus, the sewing machine 10 can generate the sewing data configured to form natural stitches.

The unit pattern is a polygon. The sewing machine 10 creates the stitch path by connecting the vertices on the contour line net, using a curved line without intersection (step S19). The stitch path is obtained by connecting the moved vertices 99 using a curved line without intersection. The sewing machine 10 can generate the sewing data by which the boundary between the stippling patterns respectively formed in the two adjacent pattern arrangement areas is less noticeable, in comparison to when the stitch path is set on the basis of the contour line net in which the specific vertices 79 are not moved toward the boundary line side.

The sewing data generation program and the sewing data generation device of the present disclosure are not limited to the above-described embodiment, and various changes may be made within the spirit and scope of the present disclosure. For example, the following modifications may be added as appropriate.

The configurations of the sewing machine 10 and the device 20 may be changed as appropriate. The device 20 may be a dedicated device or may be a mobile terminal device, such as a smart phone, a tablet PC or the like. The device 20 may be provided in the sewing machine 10. As long as the sewing machine 10 is configured to perform embroidery sewing, it may be an industrial sewing machine or a multi-needle sewing machine.

In the main processing shown in FIG. 2, a microcomputer, application specific integrated circuits (ASICs), a field programmable gate array (FPGA) or the like may be used as a processor, instead of the control portion of the sewing data generation device (the sewing machine). The main processing may be performed through distributed processing by a plurality of processors. The storage medium that stores the sewing data generation program to execute the main processing may be configured by another non-transitory storage medium, such as an HDD and/or an SSD, for example. It is sufficient that the non-transitory storage medium be a storage medium configured to store information, regardless of the period during which the information is stored. The non-transitory storage medium need not necessarily include a transitory storage medium (for example, a signal that is transmitted). The sewing data generation program used to perform the main processing may be downloaded (namely, transmitted as a transmission signal) from a server connected to a network (not shown in the drawings), for example, and may be stored in the HDD. In this case, the program may be saved in a non-transitory storage medium, such as the HDD provided in the server. The respective steps of the main processing of the above-described embodiment may be changed in order, omitted or added, as necessary. When an operating system (OS) or the like operating on the sewing data generation device performs a part or all of the actual processing on the basis of a command from the control portion of the sewing data generation device (the sewing machine) and the functions of the above-described embodiment are realized by the processing, this case is also included in the scope of the present disclosure.

The processing that sets the interval between the two closely-positioned curved sections in the stitch path of the stippling pattern may be omitted as appropriate. As the set interval of the stitch path becomes larger, the length of the convex portion in the adjacent direction may become shorter, in comparison to when the interval of the stitch path is relatively small. The length of the convex portion in the adjacent direction may be the same regardless of the interval of the stitch path. In the boundary direction orthogonal to the adjacent direction, the convex portion need not necessarily be arranged cyclically. In that case, each of the arrangement interval between the two convex portions adjacent to each other in the boundary direction may be different from each other. As the set interval of the stitch path becomes larger, the arrangement interval of the convex portions may become shorter, in comparison to when the interval of the stitch path is relatively small. The arrangement interval of the convex portions may be set to the same value regardless of the set interval of the stitch path. At least one of the length of the convex portion in the adjacent direction and the arrangement interval of the convex portions in the adjacent direction may be set corresponding to a variable other than the interval of the stitch path. At least one of the length of the convex portion in the adjacent direction and the arrangement interval of the convex portions in the adjacent direction may be set to the same value in the X direction and the Y direction.

The control portion 6 need not necessarily set the plurality of pattern arrangement areas, each of which does not exceed the size of the sewing area acquired by the processing at step S5, inside the target area acquired by the processing at step S1. The control portion 6 may omit the processing that continuously arranges the unit patterns each having the predetermined shape of the size corresponding to the interval of the stitch path set by the processing at step S3 in each of the plurality of pattern arrangement areas. The control portion 6 may omit the processing that creates the group of the contour lines of the continuously arranged unit patterns, as the contour line net to create the stitch path. When the contour line net is not created, the control portion 6 may create, for example, a randomly curved path as a candidate for the stitch path. In this case, the control portion 6 may generate the stitch path by appropriately adjusting the interval between closely-positioned curved sections in the created path and the shape of the curved sections having the above-described convex portions. The unit patterns need not necessarily be polygonal, and may be circular or the like, for example. The unit patterns may be a plurality of types of graphics. The control portion 6 need not necessarily create the stitch path of the stippling pattern on the inside of each of the plurality of pattern arrangement areas, on the basis of the path connected without intersection on the contour line net. The control portion 6 may output the sewing data and the arrangement information that have been associated with each other, to the device 20, for example, instead of to the flash memory 64.

The method for setting the boundary lines and the pattern arrangement areas may be changed as appropriate. The control portion 6 need not necessarily set the plurality of partial areas. For example, the control portion 6 may directly set the pattern arrangement areas without setting the partial areas. The control portion 6 need not necessarily set the boundary lines meandering in the adjacent direction inside the overlapping areas. The control portion 6 may set the pattern arrangement areas without setting the partial areas. The control portion 6 may continuously arrange the unit patterns in each of the pattern arrangement areas, and may thus create the contour line net. The boundary lines meandering in the adjacent direction need not necessarily be set inside the overlapping areas in accordance with the predetermined shape of the continuously arranged unit patterns. The control portion 6 may set the boundary lines meandering in the adjacent direction inside the overlapping areas, irrespective of the predetermined shape of the continuously arranged unit patterns. The control portion 6 may set the boundary lines by connecting the vertices of the continuously arranged unit patterns. The control portion 6 need not necessarily create the stitch path by connecting the vertices on the contour line net using a curved line without intersection. The control portion 6 may create the stitch path without moving, toward the boundary line side, the vertices that face the boundary line, among the vertices of the polygons represented by the contour line net created at step S4. The control portion 6 may arrange the position of the stitch path further to the boundary line side than the specific vertices without moving the specific vertices toward the boundary line side.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A non-transitory computer-readable medium storing computer-readable instructions that, when executed, cause a processor of a sewing data generation device configured to generate sewing data to perform steps comprising:

acquiring a sewing area in which a pattern is to be sewn;

acquiring a target area in which a pattern is to be arranged;

generating a plurality of sewing data, each of the plurality of sewing data being data to form stitches of a plurality of stippling patterns inside the acquired target area, each of the plurality of sewing data being data to form stitches of the stippling pattern on a stitch path having a size that is contained within the acquired sewing area, a first path and a second path being separated from each other, each of the first path and the second path being one of a plurality of the stitch paths represented by the plurality of sewing data, the second path being adjacent to the first path, each of the first path and the second path having a convex portion, positions of the convex portions in an adjacent direction being the same as each other, and the adjacent direction being a direction in which the first path and the second path are adjacent to each other inside the target area; and associating the sewing data with arrangement information, for each of the plurality of sewing data, and outputting the sewing data and arrangement information that have been associated with each other, the arrangement information indicating an arrangement of each of the stippling patterns to be sewn on the basis of the sewing data, with respect to the target area.

2. The non-transitory computer-readable medium according to claim 1, wherein the computer-readable instructions further cause the processor to perform a step comprising:

setting an interval between two closely-positioned curved sections in the stitch path, and the larger the set interval of the stitch path, the longer a length of the convex portion in the adjacent direction, in comparison to when the interval of the stitch path is relatively small.

3. The non-transitory computer-readable medium according to claim 1, wherein the computer-readable instructions further cause the processor to perform a step comprising:

setting an interval between two closely-positioned curved sections in the stitch path, and the generating of the plurality of sewing data includes arranging the convex portions in a boundary direction orthogonal to the adjacent direction, and the larger the set interval of the stitch path, the longer an interval at which the convex portions are arranged in the boundary direction, in comparison to when the interval of the stitch path is relatively small.

4. The non-transitory computer-readable medium according to claim 1, wherein the computer-readable instructions further cause the processor to perform steps comprising:

setting an interval between two closely-positioned curved sections in the stitch path, setting a plurality of pattern arrangement areas, each of which does not exceed a size of the acquired sewing area, in the acquired target area;

creating a contour line net to create the stitch path, the contour line net being a group of contour lines of unit patterns, the unit patterns being continuously arranged in each of the plurality of pattern arrangement areas, and the unit patterns each having a predetermined shape of a size corresponding to the set interval of the stitch path; and creating the stitch path of the stippling pattern on the inside of each of the plurality of pattern arrangement areas, on the basis of a path connected without intersection on the created contour line net, and the generating of the plurality of sewing data includes generating the sewing data to form the stitches of the stippling pattern on the stitch path created on the inside of each of the plurality of pattern arrangement areas.

5. The non-transitory computer-readable medium according to claim 4, wherein the computer-readable instructions further cause the processor to perform steps comprising:

setting a plurality of partial areas in the acquired target area, each of the plurality of partial areas being an area that does not exceed the size of the acquired sewing area, the partial area including an overlapping area, the overlapping area overlapping with a part of another of the partial areas that is adjacent to the partial area including the overlapping area; and setting a boundary line meandering in the adjacent direction inside the overlapping area, and the setting of the plurality of pattern arrangement areas includes setting, for each of the plurality of partial areas, as the pattern arrangement area, a side, in the partial area, that is closer to the center of the partial area than the boundary line set in the overlapping area of the partial areas.

6. The non-transitory computer-readable medium according to claim 5, wherein the creating of the contour line net includes creating the contour line net by continuously arranging the unit patterns, over the whole of the target area that includes the plurality of pattern arrangement areas, each of the unit patterns having the size corresponding to the set interval of the stitch path, and the setting of the boundary line includes setting the boundary line inside the overlapping area in accordance with the predetermined shape of the continuously arranged unit patterns.

7. The non-transitory computer-readable medium according to claim 6, wherein the setting of the boundary line includes setting the boundary line by connecting centers of the continuously arranged unit patterns.

8. The non-transitory computer-readable medium according to claim 5, wherein the predetermined shape is a polygon, and the creating of the stitch path includes creating the stitch path by connecting moved vertices using a curved line without intersection, the moved vertices being specific vertices which have been moved toward the boundary line side, each of the specific vertices being one of the vertices of the polygons represented by the created contour line net, each of the specific vertices facing the boundary line.

9. The non-transitory computer-readable medium according to claim 1, wherein the computer-readable instructions further cause the processor to perform steps comprising:

setting a plurality of partial areas in the acquired target area, each of the plurality of partial areas being an area that does not exceed a size of the acquired sewing area, the partial area including an overlapping area, and the overlapping area overlapping with a part of another of the partial areas that is adjacent to the partial area including the overlapping area;

setting a boundary line meandering in the adjacent direction inside the overlapping area;

setting, for each of the plurality of partial areas, as a pattern arrangement area, a side, in the partial area, that is closer to the center of the partial area than the boundary line set in the overlapping area of the partial areas; and creating the stitch path of the stippling pattern on the inside of each of the plurality of pattern arrangement areas, and the generating of the plurality of sewing data includes generating the sewing data to form the stitches of the stippling pattern on the stitch path created on the inside of each of the plurality of pattern arrangement areas.

10. A sewing machine comprising:

a sewing portion configured to move a needle bar up and down;

a movement portion configured to move an embroidery frame with respect to the needle bar, the embroidery frame being configured to hold a sewing object;

a processor; and a memory storing computer-readable instructions that, when executed by the processor, cause the sewing machine to perform steps comprising:

acquiring a sewing area which is to be set inside the embroidery frame and in which sewing is to be performed;

acquiring a target area in which a pattern is to be arranged;

generating a plurality of sewing data, each of the plurality of sewing data being data to form stitches of a plurality of stippling patterns inside the acquired target area, each of the plurality of sewing data being data to form stitches of the stippling pattern on a stitch path having a size that is contained within the acquired sewing area, each of the plurality of sewing data being data satisfying a condition that a first path and a second path be separated from each other, the first path and the second path being separated from each other, each of the first path and the second path being one of a plurality of the stitch paths represented by the plurality of sewing data, the second path being adjacent to the first path, Each of the first path and the second path having a convex portion, positions of the convex portions in an adjacent direction being the same as each other, and the adjacent direction being a direction in which the first path and the second path are adjacent to each other inside the target area;

associating the sewing data with arrangement information, for each of the plurality of sewing data, and outputting the sewing data and arrangement information that have been associated with each other, the arrangement information indicating an arrangement of each of the stippling patterns to be sewn on the basis of the sewing data, with respect to the target area; and sewing the stippling patterns in the target area by controlling the sewing portion and the movement portion on the basis of the sewing data and the arrangement information.

* * * * *